US007727947B2

(12) United States Patent
Somerville Roberts

(10) Patent No.: US 7,727,947 B2
(45) **Date of Patent: *Jun. 1, 2010**

(54) PROCESS FOR THE PREPARATION OF A SOLID LAUNDRY DETERGENT COMPOSITION COMPRISING LIGHT DENSITY SILICATE SALT

(75) Inventor: Nigel Patrick Somerville Roberts, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/463,534

(22) Filed: May 11, 2009

(65) Prior Publication Data

US 2009/0286710 A1 Nov. 19, 2009

(30) Foreign Application Priority Data

May 14, 2008 (EP) ..... 08156184
Feb. 9, 2009 (EP) ..... 09152397

(51) Int. Cl.
*C11D 11/00* (2006.01)
*C11D 17/06* (2006.01)
*C11D 3/08* (2006.01)

(52) U.S. Cl. ..... 510/444; 510/276; 510/509; 510/511

(58) Field of Classification Search ..... 510/276, 510/349, 444, 509, 511
See application file for complete search history.

(56) References Cited

U.S. PATENT DOCUMENTS

| | | | | | |
|---|---|---|---|---|---|
| 3,472,784 | A | | 10/1969 | Poe | |
| 3,597,361 | A | | 8/1971 | Sumner | |
| 3,625,902 | A | | 12/1971 | Sumner | |
| 3,920,586 | A | * | 11/1975 | Bonaparte et al. | 510/349 |
| 3,962,149 | A | * | 6/1976 | Chirash et al. | 510/283 |
| 4,501,499 | A | | 2/1985 | Boan et al. | |
| 4,919,847 | A | | 4/1990 | Barletta et al. | |
| 5,736,501 | A | * | 4/1998 | Yamashita et al. | 510/444 |
| 5,756,444 | A | * | 5/1998 | Walters et al. | 510/299 |
| 5,945,395 | A | * | 8/1999 | Yamashita et al. | 510/444 |
| 5,948,747 | A | * | 9/1999 | Schambil et al. | 510/443 |
| 5,958,864 | A | * | 9/1999 | Artiga Gonzalez et al. | 510/443 |

FOREIGN PATENT DOCUMENTS

| | | | |
|---|---|---|---|
| WO | WO 96/04359 | A1 | 2/1996 |
| WO | WO 97/12956 | A1 | 4/1997 |
| WO | WO 97/22685 | A1 | 6/1997 |
| WO | WO 97/30145 | A1 | 8/1997 |
| WO | WO 97/43399 | A1 | 11/1997 |
| WO | WO 98/14549 | A1 | 4/1998 |
| WO | WO 98/14550 | A1 | 4/1998 |
| WO | WO 98/58046 | A1 | 12/1998 |
| WO | WO 98/58047 | A1 | 12/1998 |
| WO | WO 99/00475 | A1 | 1/1999 |
| WO | WO 99/03966 | A1 | 1/1999 |
| WO | WO 00/24859 | A1 | 5/2000 |
| WO | WO 00/37605 | A1 | 6/2000 |
| WO | WO 03/016453 | A8 | 12/2003 |

* cited by examiner

*Primary Examiner*—Lorna M Douyon
(74) *Attorney, Agent, or Firm*—Julie A. McConihay; David V. Upite; Leonard W. Lewis

(57) ABSTRACT

The present invention relates to a process for preparing a solid laundry detergent composition comprising: (a) from 1 wt % to 40 wt % light density silicate salt having a bulk density of less than 200 g/l and a weight average particle size of less than 300 micrometers; (b) from 5 wt % to 60 wt % detersive surfactant; (c) from 0 wt % to 50 wt % carbonate salt; (d) from 0 wt % to 40 wt % sulphate salt; (e) from 0 wt % to 30 wt % phosphate builder; (f) from 0 wt % to 5 wt %% zeolite builder; and (g) from 0 wt % to 15 wt % water; wherein the composition has a bulk density of 600 g/l or less.

2 Claims, No Drawings

PROCESS FOR THE PREPARATION OF A SOLID LAUNDRY DETERGENT COMPOSITION COMPRISING LIGHT DENSITY SILICATE SALT

FIELD OF THE INVENTION

The present invention relates to a solid laundry detergent composition comprising light density silicate salt. The present invention also relates to a process for preparing a solid laundry detergent composition comprising light density silicate salt.

BACKGROUND OF THE INVENTION

There is a recent trend in the solid laundry detergent business to chemically compact the formulation by removing at least most, and preferably all, of the zeolite. However, it has proved difficult to make these chemically compacted solid laundry detergent compositions.

The Inventors have found that the incorporation of low density silicate salt into these chemically compacted formulations enables them to be produced using traditional batch processes, and even a batch single mixer processes. Whilst it is known to incorporate silicate salt into laundry detergent compositions, it was not known, prior to the present invention, to incorporate a silicate salt that has a low bulk density and a very small weight average particle size into a formulation that has been chemically compacted by removing at least most, and preferably all, of the zeolite with the expectation that such chemically compacted detergent compositions can be produced using traditional batch processes, and even batch single mixer processes.

U.S. Pat. No. 3,472,784 relates to a free-flowing particulate detergent composition that is prepared by mixing a liquid acid form of an anionic surfactant with a water-soluble alkaline material; a silicate salt is incorporated into the exemplified detergent compositions.

U.S. Pat. No. 3,597,361 relates to a method of producing agglomerates of dry detergent ingredients; liquid sodium silicate is used in the exemplified method.

U.S. Pat. No. 3,625,902 relates to a method of producing agglomerates of detergent ingredients; liquid N-silicate and magnesium silicate are incorporated into the exemplified agglomerated home automatic dishwashing composition.

U.S. Pat. No. 4,501,499 relates to an agglomerator, which is allegedly useful for uniformly agglomerating a feed consisting of a dry mix of fumed silica and sodium carbonate and a wet mixture of non-ionic detergent and polyethylene glycol, for forming an agglomerated detergent when mixed.

U.S. Pat. No. 4,919,847 relates to a particulate detergent composition; the exemplified compositions comprise a silicate salt.

WO96/04359 relates to a process for the manufacture of detergent powders wherein LAS acid is neutralized in a fluid bed; an alkali silicate is incorporated into example composition 10 and is also described as being one of several materials that are suitable flow aids in this fluid bed process.

WO97/12956 relates to a process for making a low density detergent composition by agglomeration with a hydrated salt; silicate salts are described along with numerous other ingredients as being suitable adjunct detergent ingredients.

WO97/22685, WO98/58046, WO98/58047, WO99/00475, WO03/016453 and WO03/016454 relate to a fluid bed processes wherein crystalline or amorphous alkali metal silicates are described as being one of several materials that are suitable flow aids and/or layering agents in such fluid bed processes.

WO97/30145 relates to a process for making a low density detergent composition by agglomeration with an inorganic double salt. Silicate salt is one of numerous ingredients that are mentioned as being suitable builders that can be used in the process.

WO97/43399 relates to a process for making a low density detergent composition by agglomeration followed by dielectric heating; silicate salts are described along with numerous other ingredients as being suitable adjunct detergent ingredients.

WO98/14549 and WO98/14550 relate to non-tower processes for continuously preparing low density granular detergent compositions; crystalline layered silicate is described as one of several suitable fine powders that are used as a coating material in the process.

WO99/03966 relates to a process for making a low density detergent composition by controlling the nozzle height in a fluid bed dryer; sodium silicate is incorporated in the exemplified composition.

WO00/24859 relates to detergent particles and processes for making them; silicate salts are exemplified as a suitable ingredient for incorporation into the example detergent compositions.

WO00/37605 relates to a process for making a low bulk density detergent composition by agglomeration; silicate salts are described along with numerous other ingredients as being suitable adjunct detergent ingredients.

SUMMARY OF THE INVENTION

The present invention provides a solid laundry detergent composition and a process for its preparation as defined by the claims.

DETAILED DESCRIPTION OF THE INVENTION

Solid Laundry Detergent Composition

The solid laundry detergent composition has a bulk density of 600 g/l or less, preferably 500 g/l or less, or 450 g/l or less, or 400 g/l or less, or even 350 g/l or less. The method for measuring the bulk density of a powder is described in more detail below.

The solid laundry detergent composition typically has a cake strength of from 5N to 20N.

The solid laundry detergent composition typically comprises from 3 wt % to 10 wt % water. The method for determining the moisture level of the solid laundry detergent composition is described in more detail below.

Light Density Silicate Salt

The composition comprises light density silicate salt. In one aspect, the composition comprises from 1 wt % to 40 wt % light density silicate salt. In one aspect, the light density silicate salt has a bulk density of less than 200 g/l, or less than 150 g/l, or less than 100 g/l. In one aspect, the light density silicate has a weight average particle size of less than 300 micrometers, or less than 200 micrometers, or even less than 100 micrometers. Typically, the light density silicate salt is obtainable, or obtained, by a flash-drying process.

Typically, the light density silicate salt is a sodium silicate salt.

Detersive Surfactant

The composition comprises from 5 wt % to 60 wt % detersive surfactant. The detersive surfactant can be selected from anionic detersive surfactants, cationic detersive surfactants, nonionic detersive surfactants, zwitterionic Detersive surfactants, amphoteric detersive surfactants, and mixtures thereof.

Preferably, the detersive surfactant comprises anionic detersive surfactant. Suitable anionic detersive surfactants are alkoxylated alcohol sulphate anionic detersive surfactants such as linear or branched, substituted or unsubstituted ethoxylated $C_{12-18}$ alcohol sulphates having an average degree of ethoxylation of from 1 to 10, preferably from 3 to 7. Other suitable anionic detersive surfactant are alkyl benzene sulphonate anionic detersive surfactants such as linear or branched, substituted or unsubstituted $C_{8-18}$ alkyl benzene sulphonates, preferably linear unsubstituted $C_{10-13}$ alkyl benzene sulphonates. Other suitable anionic detersive surfactants are alkyl sulphates, alkyl sulphonates, alkyl phosphates, alkyl phosphonates, alkyl carboxylates or any mixture thereof.

The detersive surfactant may also comprise non-ionic detersive surfactants. Suitable non-ionic detersive surfactants are selected from: $C_{8-18}$ alkyl alkoxylated alcohols having an average degree of alkoxylation of from 1 to 20, preferably from 3 to 10, most preferred are $C_{12-18}$ alkyl ethoxylated alcohols having an average degree of alkoxylation of from 3 to 10; and mixtures thereof.

The detersive surfactant may also comprise cationic detersive surfactants. Preferred cationic detersive surfactants are mono-$C_{6-18}$ alkyl mono-hydroxyethyl di-methyl quaternary ammonium chlorides, more preferred are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Carbonate Salt

The composition comprises from 0 wt % to 50 wt % carbonate salt. A preferred carbonate salt is sodium carbonate, sodium bicarbonate and a mixture thereof. A most preferred carbonate salt is sodium carbonate.

Sulphate Salt

The composition comprises from 0 wt % to 40 wt % sulphate salt. A preferred sulphate salt is sodium sulphate.

Phosphate Builder

The composition comprises from 0 wt % to 30 wt % phosphate builder. It may even be preferred for the composition to be essentially free from phosphate builder. By essentially free from phosphate builder it is typically meant that the composition comprises no deliberately added phosphate builder. This is especially preferred if it is desirable for the composition to have a very good environmental profile. Phosphate builders include sodium tripolyphosphate.

Zeolite Builder

The composition comprises from 0 wt % to 5 wt % zeolite builder. It may even be preferred for the composition to be essentially free from zeolite builder. By essentially free from zeolite builder it is typically meant that the composition comprises no deliberately added zeolite builder. This is especially preferred if it is desirable for the composition to be very highly water-soluble, to minimize the amount of water-insoluble residues (for example, which may deposit on fabric surfaces), and also when it is highly desirable to have transparent wash liquor. Zeolite builders include zeolite A, zeolite X, zeolite P and zeolite MAP.

Adjunct Detergent Ingredients

The composition may comprise adjunct detergent ingredients. Suitable adjunct detergent ingredients are selected from: source of peroxygen such as percarbonate salts and/or perborate salts, preferred is sodium percarbonate, the source of peroxygen is preferably at least partially coated, preferably completely coated, by a coating material such as a carbonate salt, a sulphate salt, a silicate salt, borosilicate, or mixtures, including mixed salts, thereof; bleach activator such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide, preformed peracids such as N,N-pthaloylamino peroxycaproic acid, nonylamido peroxyadipic acid or dibenzoyl peroxide; polymeric carboxylates, preferably co-polymers of maleic acid and acrylic acid and salts thereof; enzymes such as amylases, carbohydrases, cellulases, laccases, lipases, oxidases, peroxidases, proteases, pectate lyases and mannanases; suds suppressing systems such as silicone based suds suppressors; fluorescent whitening agents; photobleach; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as hydrophobically modified cellulose and oligomers produced by the condensation of imidazole and epichlorhydrin; soil dispersants and soil anti-redeposition aids such as alkoxylated polyamines and ethoxylated ethyleneimine polymers; anti-redeposition components such as carboxymethyl cellulose and polyesters; perfumes; sulphamic acid or salts thereof; citric acid or salts thereof; and dyes such as orange dye, blue dye, green dye, purple dye, pink dye, or any mixture thereof.

A Batch Process for the Preparation of a Detergent Composition

In one aspect of the present invention, there is provided a batch process for the preparation of a detergent composition, the process comprises the steps of: (i) introducing starting materials in a mixer and mixing so as to form a first composition of matter, wherein the first composition of matter preferably has a cake strength of from 20N to 80N; and (ii) introducing solid particulate material preferably having a bulk density of less than 200 g/l and preferably a weight average particle size of less than 100 micrometers into the mixer and mixing so as to form a solid detergent composition, wherein preferably the cake strength of the solid detergent composition is less than the cake strength of the first composition of matter.

Typically, the liquid material is introduced into the mixer along with the solid particulate material in step (ii). Typically, the liquid material comprises an acidic anionic detersive surfactant precursor. Typically the solid particulate material of step (ii) is a light density silicate salt. Typically, a first portion of light density silicate salt is dosed into the mixer in step (i), and a second portion of the light density silicate salt is subsequently dosed into the mixer in step (ii).

A Process for the Preparation of a Detergent Composition

In one aspect of the present invention, there is provided a process for the preparation of a detergent composition, wherein silicate salt starting material is spray-dried in a spray-drying tower to form light density silicate salt, preferably having a bulk density of less than 200 g/l, and preferably a weight average particle size of less than 100 micrometers.

Method for Measuring the Bulk Density of a Powder

The bulk density is typically determined by the following method:

Summary: A 500 ml graduated cylinder is filled with a powder, the weight of the sample is measured and the bulk density of the powder is calculated in g/l.

Equipment:

1. Balance. The balance has a sensitivity of 0.5 g.
2. Graduated cylinder. The graduated cylinder has a capacity 500 ml. The cylinder should be calibrated at the 500 ml mark, by using 500 g of water at 20° C. The cylinder is cut off at the 500 ml mark and ground smooth.
3. Funnel. The funnel is cylindrical cone, and has a top opening of 110 mm diameter, a bottom opening of 40 mm diameter, and sides having a slope of 76.4° to the horizontal.
4. Spatula. The spatula is a flat metal piece having of a length of at least 1.5 times the diameter of the graduated cylinder.
5. Beaker. The beaker has a capacity of 600 ml.
6. Tray. The tray is either a metal or plastic square, is smooth and level, and has a side length of at least 2 times the diameter of the graduated cylinder.
7. Ring stand.
8. Ring clamp.
9. Metal gate. The metal gate is a smooth circular disk having a diameter of at least greater than the diameter of the bottom opening of the funnel.

Conditions: The procedure is carried out indoors at conditions of 20° C. temperature, $1\times10^5$ $Nm^{-2}$ pressure and a relative humidity of 25%.

Procedure:

1. Weigh the graduated cylinder to the nearest 0.5 g using the balance. Place the graduated cylinder in the tray so that it is horizontal with the opening facing upwards.
2. Support the funnel on a ring clamp, which is then fixed to a ring stand such that the top of the funnel is horizontal and rigidly in position. Adjust the height of the funnel so that its bottom position is 38 mm above the top centre of the graduated cylinder.
3. Support the metal gate so as to form an air-tight closure of the bottom opening of the funnel.
4. Completely fill the beaker with a 24 hour old powder sample and pour the powder sample into the top opening of the funnel from a height of 2 cm above the top of the funnel.
5. Allow the powder sample to remain in the funnel for 10 seconds, and then quickly and completely remove the metal gate so as to open the bottom opening of the funnel and allow the powder sample to fall into the graduated cylinder such that it completely fills the graduated cylinder and forms an overtop. Other than the flow of the powder sample, no other external force, such as tapping, moving, touching, shaking, etc, is applied to the graduated cylinder. This is to minimize any further compaction of the powder sample.
6. Allow the powder sample to remain in the graduated cylinder for 10 seconds, and then carefully remove the overtop using the flat edge of the spatula so that the graduated cylinder is exactly full. Other than carefully removing the overtop, no other external force, such as tapping, moving, touching, shaking, etc, is applied to the graduated cylinder. This is to minimize any further compaction of the powder sample.
7. Immediately and carefully transfer the graduated cylinder to the balance without spilling any powder sample. Determine the weight of the graduated cylinder and its powder sample content to the nearest 0.5 g.
8. Calculate the weight of the powder sample in the graduated cylinder by subtracting the weight of the graduated cylinder measured in step 1 from the weight of the graduated cylinder and its powder sample content measured in step 7.
9. Immediately repeat steps 1 to 8 with two other replica powder samples.
10. Determine the mean weight of all three powder samples.
11. Determine the bulk density of the powder sample in g/l by multiplying the mean weight calculated in step 10 by 2.0.

EXAMPLES

Definitions

HLAS: $C_{11-13}$ linear alkyl benzene sulphonic acid (anionic surfactant acid precursor)

LAS: Sodium $C_{11-13}$ linear alkyl benzene sulphonate (anionic surfactant)

Example 1

A F20 Bella paddle mixer is switched on and run at a tip speed of 1.4 $ms^{-1}$.

Step (i) 1642 g light sodium carbonate and 500 g low density sodium silicate (bulk density 120 g/l, weight average particle size of 240 micrometers) are dosed into a F20 Bella paddle mixer to form a first composition of matter.

Step (ii) 2450 g HLAS liquid is then sprayed into the F20 Bella paddle mixer through a Spray Systems 95/01 pressure nozzle over a period of four minutes. The temperature of the HLAS is 60° C. Concurrently with the HLAS spray addition, 3483 g light sodium carbonate is also dosed into the F20 Bella paddle mixer. 710 g of a 47 w/w % active aqueous polymer solution is then sprayed into the F20 Bella paddle mixer through a Spray Systems 95/01 pressure nozzle. 2707 g sodium sulphate, 1674 g low density sodium silicate (bulk density 120 g/l) and 156 g of minor dry ingredients (including brighteners, magnesium sulphate and carboxymethyl cellulose powder) are then dosed into the F20 Bella paddle mixer. The total time of addition of all of the above ingredients is seven minutes. The solid laundry detergent composition formed in the F20 Bella paddle mixer is then collected from the paddle mixer. The bulk density of the solid laundry detergent composition is less than 600 g/l and had the following composition:

20.5 wt % LAS
35.6 wt % Sodium carbonate
16.5 wt % Sodium silicate
20.6 wt % Sodium sulphate
3.2 wt % Water
2.5 wt % Polymers
1.1 wt % Minors The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A batch process for the preparation of a detergent composition having a bulk density of 600 g/l or less comprising:

(a) from 1 wt % to 40 wt % light density silicate salt having a bulk density of less than 100 g/l and a weight average particle size of less than 300 micrometers;

(b) from 5 wt % to 60 wt % detersive surfactant;

(c) from 0 wt % to 50 wt % carbonate salt;

(d) from 0 wt % to 40 wt % sulphate salt;

(e) from 0 wt % to 30 wt % phosphate builder; and (f) 3 wt % to 10 wt % water;

wherein: the detergent composition has a cake strength of from 5N to 20N; and the composition is essentially free from zeolite builder, and does not comprise nonionic detersive surfactants, the process comprises the steps of:

(i) introducing starting materials in a mixer and mixing so as to form a first composition of matter;

(ii) introducing said light density silicate salt and a liquid acidic anionic detersive surfactant precursor and mixing so as to form a solid detergent composition.

2. A process according to claim 1, wherein, a first portion of light density silicate salt is dosed into the mixer in step (i), and wherein a second portion of the light density silicate salt is subsequently dosed into the mixer in step (ii).

* * * * *